United States Patent [19]

Ishiyama et al.

[11] 3,979,220

[45] Sept. 7, 1976

[54] METHOD FOR TREATING AND RINSING METAL ARTICLES

[75] Inventors: Koichi Ishiyama, Yokohama; Yuji Sakata, Omiya; Ikuo Wada, Fujisawa, all of Japan

[73] Assignee: Ebara Udylite Kabushiki Kaisha, Tokyo, Japan

[22] Filed: Oct. 31, 1974

[21] Appl. No.: 519,707

[30] Foreign Application Priority Data

| | | |
|---|---|---|
| Nov. 15, 1973 | Japan | 48-128635 |
| Nov. 22, 1973 | Japan | 48-131483 |
| Jan. 25, 1974 | Japan | 49-10643 |

[52] U.S. Cl. ..... 134/10; 134/12; 134/109; 204/232; 204/239

[51] Int. Cl.[2] ..... B08B 7/04; C23G 1/36

[58] Field of Search ..... 134/10, 12, 60, 109, 134/111; 204/32 R, 232, 239; 55/71, 73

[56] References Cited

UNITED STATES PATENTS

| | | | |
|---|---|---|---|
| 2,047,611 | 7/1936 | Baxter | 55/71 X |
| 2,428,221 | 9/1947 | Hudson | 134/12 X |
| 2,529,762 | 11/1950 | Brisse | 134/10 |
| 2,721,562 | 10/1955 | Irvine | 134/12 X |
| 2,993,492 | 7/1961 | Mains et al. | 134/60 X |
| 3,445,284 | 5/1969 | Robinson et al. | 134/10 X |
| 3,849,197 | 11/1974 | Sorrentino | 134/10 |

*Primary Examiner*—S. Leon Bashore
*Assistant Examiner*—Marc L. Caroff
*Attorney, Agent, or Firm*—Blum, Moscovitz, Friedman & Kaplan

[57] ABSTRACT

Metal articles are sequentially treated in a surface-treatment tank containing a solution of surface-treating agents, then rinsed in a plurality of series-connected water-washing tanks.

The contents of the surface-treatment tank and water-washing tanks are cycled to a concentrator by way of a heat exchanger and concentrated solution is returned to the surface-treatment tank. Steam is condensed in the heat exchanger to cause evaporation of water in the concentrator and the steam condensate is transferred to the water-washing tanks.

7 Claims, 8 Drawing Figures

METHOD FOR TREATING AND RINSING METAL ARTICLES

BACKGROUND OF THE INVENTION

In conventional metal surface-treating processes, a stationary, rinsing tank (usually called a recovery tank) is provided downstream of the surface-treatment tank to wash a treated article with water, or a one-staged or multi-staged running-water tank is provided to pre-treat an article to be surface-treated and the so pre-treated article is immersed in a surface-treating solution tank to effect the surface treatment on the article. The surface-treating solution used is continuously concentrated by a concentration device, and is then recycled to the surface-treating solution tank for reuse.

Acids such as mineral acids and organic acids and alkalis to be used as pre-treating solutions are examples of surface treating solutions; others are electroplating solutions, organic coating solutions, chemical treatment solutions, anodic oxidizing solutions and the like. Surface-treating solutions heretofore employed generally comprise from one to several inorganic chemicals acting as main ingredients, and small amounts of organic or inorganic auxiliary chemicals and additives incorporated as gloss-levelling agents, agents for removing impurities or draining agents. In the use of surface-treating solutions containing such ingredients, the surface treatment is conducted by selecting appropriately the concentration of each ingredient, the temperature, the pH, the electric circuit and other conditions. Control or maintenance of such surface-treating solution is troublesome and requires complicated steps. More specifically, various foreign substances such as those contained in drippings coming from the preceding step, those formed by falling and dissolution of an article to be treated in the surface-treating solution, those contained in a surface-treating solution of the preceding step carried forward as a result of a damage of a fixture for supporting the article to be treated, and dust from the ambient air are incorporated into the surface-treating solution, so that substances adversely influencing the surface treatment are accumulated in the surface-treating solution. Accordingly, the problem of aging of the surface-treating solution is unavoidable in the conventional techniques.

At the step subsequent to the surface-treatment tank, a plated article is washed in a one-staged or multi-staged water-washing tank. Carryover or dragout of the surface treating solution used at the preceding step into the water-washing tank cannot be avoided, because it is carried forward to the water-washing tank together with the plated article. In order to prevent loss of effective and valuable chemical ingredients of the surface-treating solution, it is desirable to recover these chemical ingredients from that water-washing liquid for reuse in the process.

Further, many of the chemical ingredients introduced into the rinsing liquid from the surface-treating solution are harmful to humans, and therefore, an expensive discharge-treatment apparatus must be provided if it is desired to discharge such rinsing liquid outside the system.

A mist is usually generated from the surface-treatment tank; this mist may contain essential and valuable chemical ingredients of the surface-treating solution. If they are not recovered from the mist, an economic loss ensues, and moreover, these ingredients frequently are harmful to the human body. Therefore, it is essential to treat such mist effectively.

In conducting such a surface-treatment process, a continuous concentration method using a device for concentration of surface-treating solutions is very effective; however, since a gas, or air containing the above-mentioned poisonous mist generated in the surface-treatment tank, is generally employed as the gas circulated in the concentration device, the evaporation capacity of the concentration device will vary depending on the change of the wet-bulb temperature, though the temperature of the process solution circulated in the concentration device is maintained at a constant level, with the result that the surface-treatment operation becomes unstable. Further, this method is unsatisfactory in that the treatment cost is high.

In the metal surface-treatment process, it is frequently an important requirement to control the temperature of the treating solution in the surface-treatment tank within a certain narrow range. In the treatment method of the system where a concentration device is connected to the surface-treatment tank, the temperature of the solution in the surface-treatment tank is greatly influenced by the liquid temperature in the concentration device, which is another problem involved in the conventional techniques.

In the water-washing tank subsequent to the surface-treatment tank, there is a problem in that the number of water-washing tanks must be high in order to provide effective rinsing as well as effective recovery of the treatment-tank ingredients and hence, the apparatus space must be large.

Many attempts have heretofore been made to solve these problems involved in the conventional techniques, but none of them have succeeded in giving satisfactory results. Accordingly, it is now generally conceded in the art that it is impossible to solve all of the foregoing problems by a simple unit-treatment system, and the various problems are considered separately and it is now tried to solve these problems separately.

SUMMARY OF THE INVENTION

It is a primary object of this invention to provide a method and apparatus for treating a metal-surface-treating solution and a rinsing liquid for water-washing a surface-treated-metal article, in which effective chemical ingredients released from the surface treating solution can be recovered for re-use and the treatment of the rinsing liquid is performed in a completely closed system so that no waste is discharged from the system and components harmful to human bodies are not discharged from the treatment system at all.

It is another object of this invention to provide a metal-surface-treatment system in which the surface-treating solution and rinsing liquid are concentrated and hence, a rinsing liquid containing substances harmful to human bodies, such as cyanides, chromium, heavy metals and the like is not discharged as waste water from the treatment system.

Still another object of this invention is to provide a metal-surface-treatment method and apparatus which is a completely closed system in which incorporation of foreign substances into the surface treating solution and accumulation of them in the treating solution can be effectively prevented.

A further object of this invention is to provide a metal-surface-treatment method which can overcome defects involved in the conventional metal-surface-treatment process using a concentration device, wherein the metal article-washing effect can be maintained at a constant level by holding the water flow rate constant at the water-washing step and by utilizing the rinsing liquid used for water-washing for changing and controlling the evaporation rate in the concentration device, whereby the metal-surface treatment can be performed stably.

A still further object of this invention is to provide a method and apparatus for the metal-surface treatment in which the liquid temperature in the surface-treatment tank is not influenced by the evaporation operation in the concentration device and hence, can be maintained at a constant level, whereby the surface treatment can be performed under good conditions stably.

A still further object of this invention is to provide a metal-surface-treatment method and apparatus in which the number of water-washing tanks is decreased and the entire space for the treatment is diminished.

A still further object of this invention is to provide an improved concentration device for use in the metal-surface-treatment process.

In this invention, the foregoing objects can be attained by a method and apparatus for treating a metal-surface-treating solution and a rinsing liquid, in which a process solution flows through a specific surface-treatment tank and at least one water-washing tank provided downstream of the surface-treatment tank, in the direction opposite to the forward direction of treated articles which are successively transported and is introduced into a concentration process connected to said surface-treatment tank to separate and recover effective ingredients of the surface-treating solution from the process solution by subjecting the process solution continuously to the concentration treatment, and washing water is supplied at a prescribed rate from a water source to a final water-washing tank for washing surface-treated metal articles and in which components harmful to human bodies which are contained in an exhaust gas generated in the surface treatment tank are collected and introduced into said concentration process to separate and recover effective ingredients of the surface treating solution, whereby the total process is conducted in a completely closed system without discharging effective ingredients of the surface treating solution outside the system. According to this invention having the foregoing features, the effective chemical ingredients of the surface-treating solution, which are incorporated in the rinsing liquid, can be assuredly recovered and used again for the surface treatment, none of ingredients harmful to human bodies which are contained in the process solution are discharged outside the treatment system, and the metal surface treatment can be accomplished effectively with a minimum amount of washing water under optimum treatment conditions.

The term "process solution" used in the instant specification and claims includes a surface-treating solution, a rinsing liquid and a drain.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangement of parts which are adapted to effect such steps, all as exemplified in the following disclosure, and the scope of the invention will be indicated in the claims.

BRIEF DESCRIPTION OF THE DRAWINGS

For a fuller understanding of the invention, reference is had to the following description taken in connection with the accompanying drawings, in which, using the electroplating process, and, more particularly, chromium-plating, as an example of a surface-treatment process.

DESCRIPTION OF THE PREFERRED EMBODIMENTS

Figure 1:
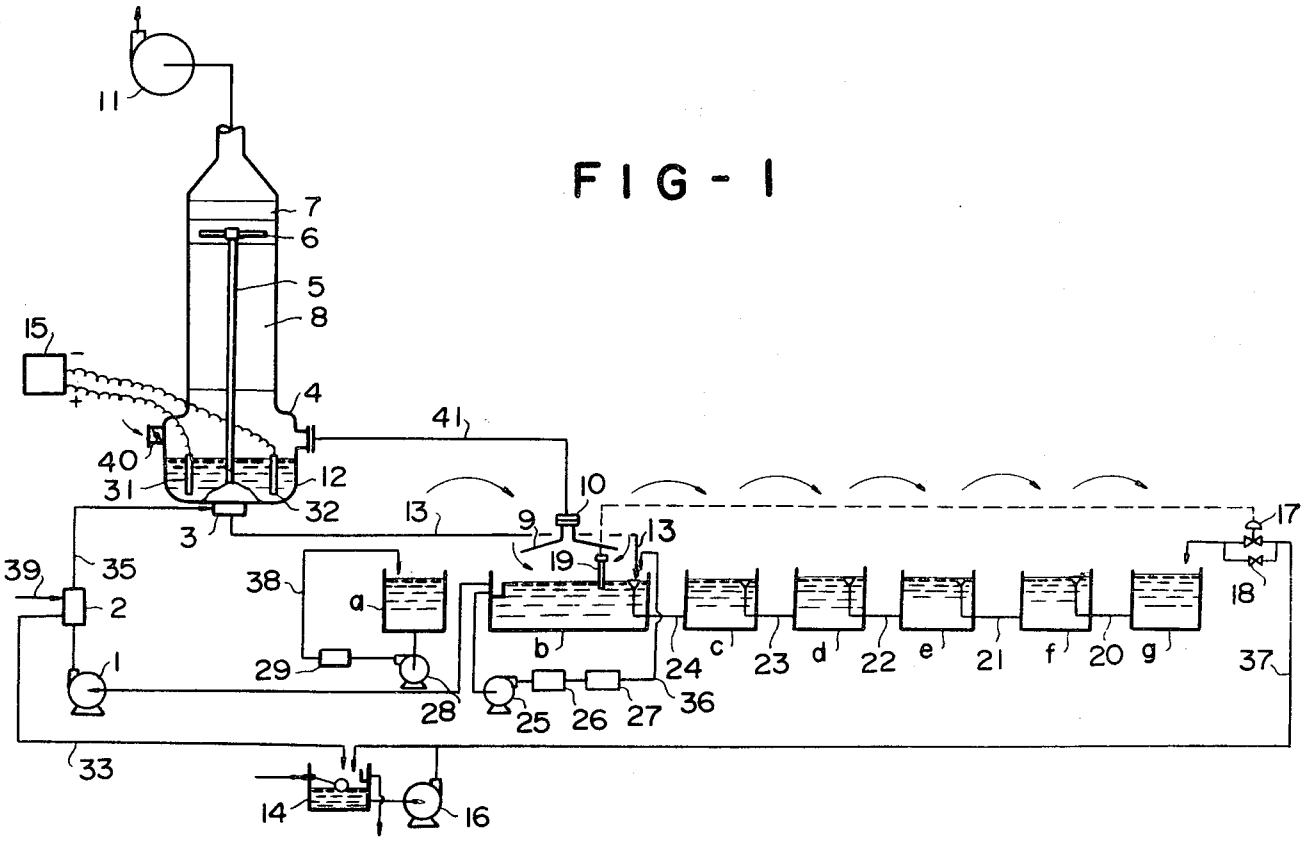
FIG. 1 is a flow sheet of one embodiment of this invention.

As shown in FIG. 1, articles to be treated are immersed successively in water-washing tank *a* for preliminary water-washing treatment, in surface-treatment tank *b* for chromium-plating bath treatment and in a plurality of water-washing tanks *c*, *d*, *e*, *f* and *g* for rinsing treatment. These tanks are so arranged that the tank *a* constitutes the preliminary water-washing step, the tank *b* constitutes the chromium-plating step and the tanks *c*, *d*, *e*, *f* and *g* constitute the rinsing step. The plating solution is taken from the surface-treatment tank *b* by pump 1 and passed through a heat exchanger 2, where the plating solution is heated to a prescribed temperature. The surface-treatment tank *b* is connected to concentration device 4 so that the plating solution is sprinkled into the concentration device 4 through a water-receiving tank 3 and a main tube 5, and the sprinkled plating solution is caused to have counter-current contact with a gas entering from below in a packed bed 8 from which it falls into storage tank 12 disposed in the lower portion of the concentration device 4. Then, it naturally falls in a tubing 13 and is thus returned to the treatment tank *b*.

A harmful mist generated from the surface-treating solution in the surface-treatment tank *b* is sucked into hood 9 and is introduced into the concentration device 4 through air filter 10. Then, it is brought into gas-liquid contact with the plating solution already heated by the heat exchanger 2 in the packed bed 8. Harmful ingredients contained in the mist are separated from the gas by mist catcher 7. The purified gas is discharged as purified air into the outside by exhaust fan 11.

The steam which has been used for heat exchange in the heat exchanger 2 is converted to condensed water and stored in condensed-water store tank 14. A prescribed amount of water is supplied from this tank to the final water-washing tank *g* through control valve 17 and by-pass valve 18 by means of pump 16.

The liquid levels of the surface treatment tank *b* and water washing tanks *c*, *d*, *e*, *f* and *g* decrease gradually in the direction from the tank *g* toward the tank *b*, so that the rinsing liquid can flow counter-current to plated articles, overflow tubes 20, 21, 22, 23 and 24 are provided in these tanks, respectively, so that every two adjacent tanks are connected to each other by these overflow tubes.

The amount of rinsing liquid is controlled by switch-over of the control valve 17 such as an electromagnetic valve (not shown) in tube 33, which is actuated in response to sensor 19 which notes the liquid level in surface treatment tank *b*. In preliminary water-washing tank *a* provided upstream of the surface-treatment tank *b*, in order to minimize accumulation of impurities in the surface treatment tank *b*, the rinsing liquid in the water-washing tank *a* is continuously circulated through an impurity-removal device 29 by means of a circulation pump 28 so that contents of impurities in the rinsing liquid are reduced as much as possible. Further, in order to prevent aging of the treating solution in the surface-treatment tank *b* by accumulation of impurities, a circulation pump 25 is provided and impurity-removal devices are disposed on the output side of said pump 25 to remove impurities from the treating solution in surface-treatment tank *b*. Likewise, insoluble electrodes 31 and 32 as impurity-removal devices are mounted in tank 12 positioned in the lower portion of concentration device 4. Each of the electrodes 31 and 32 is connected to rectifier 15 and they are so constructed that electrolysis is performed under certain electrolyzing conditions to remove impurities.

The packed bed 8 of the concentration device 4 has therein a filtering filler to perform washing, absorption and concentration of harmful mists. It is also possible to employ other known packed columns, for example, a concentration apparatus (not shown) comprising a plurality of partitioning wet walls and members floatable and rotatable by a gas flow, which are retained in individual spaces formed by the partitioning walls; it is also possible to provide a device in which partitioning walls are so disposed that the treating solution is divided depending on concentration by these partitioning walls and the divided portions of the treating solution are treated accordingly.

A portion of an article to be treated, which is hung on a rack, may be dissolved in the surface-treating solution which may be a plating solution. The dissolved material accumulates in the treating solution in the form of metal ions. The above-mentioned impurity removal devices 26 and 27 are disposed for removal of such metal ions. Cation-exchange resins or cation-exchange membranes can be used as these devices 26 and 27 for removal of metal ions from the treating solution in the surface-treatment tank. A strainer or a preliminary filter of active carbon can be used according to need.

In FIG. 1, reference numerals 35 and 36 indicate treating-solution circulation tubes, and reference numerals 33, 37 and 38 designate washing-water circulation tubes. Reference numerals 39, 40 and 41 indicate a tube for introducing a heating medium such as steam, a suction valve and an exhaust tube, respectively.

An article to be plated is first cleaned in water-washing tank *a* and then plated or otherwise treated in surface-treatment tank *b*. The article is then immersed successively into a series of water-washing tanks *c*, *d*, *e*, *f* and *g* to complete the plating treatment. As the article is transferred from tank *b*, a certain amount of treating solution sticks to the article, i.e., is dragged out and is carried into the subsequent water-washing tank. At present, treated articles are rinsed by employing water in an amount scores of times to several hundred times the amount of drag-out. In accordance with the present invention, the amount of the rinsing liquid can be greatly reduced to an amount corresponding with the amount of water evaporated by the concentration device 4. It is theoretically known that if the amount of the drag-out is *h* and the amount of washing water introduced into the water washing tank is 10 times the amount of the drag-out, namely 10 *h*, the concentration of the drag-out in the rinsing liquid is 1/10 (=*h*/10 *h*). The amount *h* varies depending on the scale and kind of the surface treatment equipment, but it is generally within a range of from 5 to 20 l/hr. Assuming that the amount of drag-out is 10 l/hr, that amount of washing water is 10 times the amount of the drag-out, namely 100 l/hr and that the surface-treating solution has a concentration of 150 g/l as metal ions, then since the concentration is reduced by 1/10 per washing-tank stage in the embodiment of this invention illustrated in FIG. 1, the concentration of the treating solution which is 150 g/l in surface treatment tank *b*, is reduced to 15 g/l in tank *c*, 1.5 g/l in tank *d*, 150 ppm in tank *e*, 15 ppm in tank *f* and 1.5 ppm in tank *g*. The liquid level of surface-treatment tank *b* is detected by the sensor 19, and a signal is sent from the sensor 19 to the control valve 17 in the tube 37 to control the amount of washing water.

The supply rate of water to tank *g* is established in accordance with the change of the evaporation rate in the concentration device. The evaporation rate depends on the ambient temperature and humidity and on the evaporation loss from the surface treatment tank *b* and the drag-out from the surface treatment tank *b*. Further, articles are moved into each water-washing tank continuously with certain intervals. Therefore, it is not permissible to effect the so-called on-off control in which water supply is sometimes stopped completely. Accordingly, a by-pass valve 18 is disposed to provide a small continuous flow of water; if a large amount of water should be desired, the addition of same is accomplished by controlling the liquid level of surface-treatment tank *b*.

In a closed system in which discharge of a gas or liquid containing substances harmful to human bodies is completely prevented, the problem of accumulation of impurities occurs. For instance, even city water contains various ions, for example, positive ions such as those of calcium, magnesium, iron and manganese and negative ions such as those of chlorine, sulfuric acid and phosphoric acid. These ions accumulate in the surface-treatment tank and degrade the plating operation. Accordingly, in this embodiment removal of impurities which could have a deleterious effect on a chromium-plating solution is taken into consideration. For example, condensed water coming from the heat-exchanger 2 used for heating the surface-treating solution is supplied to tank 14 and employed as the rinsing liquid in the final washing tank *g* to decrease the amount of make-up washing water required. Furthermore, since condensed water has a higher purity than city water, accumulation of impurities in the surface-treatment tank *b* is slowed.

In case a gas to be used for carrying off a harmful mist present on the surface-treatment tank *b* contains coarse dusts or pollutants derived from air, it is apprehended that the plating solution will be contaminated during gas-liquid contact in the concentration device. In this embodiment, this contamination is prevented in the following manner. An air filter 10 is disposed between draft box 9 and concentration device 4 so as to prevent contamination of the surface-treating solution and accumulation of impurities. Further, in order to prevent drag-out of pollutants into the surface-treatment tank *b* from the preceding step, an impurity-removal device 29, comprising a circulation pump connected to the preceding step and an ion-exchange resin bed is provided, whereby the quality of water in the preceding tank *a* is maintained at a high level. If pure water is initially introduced into this preceding tank *a*, best results can be obtained when the amount and kind of the ion-exchange resin of the impurity removal device 29 are suitably chosen depending on the quality of water used for filling said tank *a*.

The chromium-plating solution is greatly influenced by accumulation of chlorine ions and when the chlorine ion content reaches 100 to 500 ppm, the quality of the plate deposited on plated articles is degraded. The critical chloride ion content varies to some extent depending on the shape of the plated article and plating conditions. In this embodiment, in order to prevent accumulation of chlorine ions, they are removed in the form of chlorine gas produced by electrolysis in tank 4. Preferably the anode current density is 2 to 10 times as high as the cathode current density.

The electrolysis may be conducted in the process solution at any member connected to the surface-treatment tank; in the embodiment shown in FIG. 1, removal of chlorine is effected by conducting the electrolysis in the storage tank disposed in the lower portion of the concentration device at an anode current density of 5–150 $A/dm^2$ and preferably 20–100 $A/dm_2$. The cathode current density is 1–30 $A/dm^2$ and preferably 10–30 $A/dm^2$. In this case, increase of the tri-valent chromium ion is accelerated in the chromium-plating tank *b*. If the content of the tri-valent chromium ion exceeds a certain level, undesired influences are imposed on the plating solution. Removal of the tri-valent chromium is accomplished by increasing the anode area in the chromium-plating solution. It is also possible to provide an electrolysis apparatus customarily used for attaining such removal effects.

Anode 31 may be of the type used in chromium plating, namely lead or a lead-tin alloy. The cathode may be of iron or platinum.

Influences of accumulation of metal oxides on properties of the plating solution are relatively small, but if the metal oxide content exceeds 2 to 20 g/l in the plating solution, the activity of the plating solution is degraded. Accordingly, it is preferred that the above-mentioned impurity removal device 29 connected to tank *a* preceding surface-treatment tank *b* is so combined with the impurity-removal devices 26 and 27 connected to the surface-treatment tank that also metal oxide can be removed effectively.

The embodiment of this invention shown in FIG. 1 is now described more specifically by references to actual operation data. The temperature of the process solution in the surface treatment tank *b* is about 50°C, and the temperature of the process solution is 52°C at the outlet of heat exchanger 2 and 40°C in tube 13. The temperature of the gas entering draft box 9 is 30°C and the gas temperature at the outlet of the concentration device 4 is 45°C. The quantity of the gas removed is 140 $m^3$/min, the amount of process solution circulated in the concentration device 4 is 330 l/min, the evaporation rate is 110 l/hr, the amount of water supplied to the final water-washing tank is 110 l/hr, and the amount of process solution dragged out from the surface-treatment tank is 8 l/hr. When a plating operation is conducted under the above conditions, the concentration of the surface-treating solution as $CrO_3$, is 300 g/l in the surface-treatment tank *b*, this is reduced to 23 g/l in tank *c*, 1.7 g/l in tank *d*, 126 ppm in tank *e*, 9.7 ppm in tank *f* and 0.8 ppm in tank *g*.

In the foregoing embodiment of the metal-surface-treatment process, a specific surface-treatment tank and a series of subsequent water-washing tanks are connected in a cycle so that liquid levels of these tanks are gradually changed to move the treating solution counter-current to the direction of advance of articles to be surface-treated; a concentration device is provided in the surface-treatment tank to effect evaporation continuously; the lowering of the liquid level corresponding with the amount evaporated of the liquid is detected and water is supplied to a final water-washing tank in response to the signal of detecting means. Effective ingredients contained in the exhaust gas can be efficiently collected and re-used for the metal-surface treatment and the water-washing is performed in a completely closed system without discharging waste water. By virtue of the foregoing features, plating chemicals, which are thrown away in the state contained in the drag-out of the treating solution in the conventional processes, can be recovered virtually completely and utilized repeatedly for the surface treatment. Further, since no waste water is discharged, provision of a waste-water-treatment apparatus which is indispensable in the conventional processes, or use of chemicals for the waste-water treatment is quite unnecessary in the above embodiment of this invention. Moreover, since the waste-water treatment need not be conducted, no sludge is formed and hence, the amount of water required for washing can be reduced to 1/20–1/30 of the amount necessary in the conventional processes. Furthermore, in the conventional processes, provision of cooling tubes in tank *b* is indispensable because the bath temperature is increased by heat generation, whereas in the above embodiment of this invention such cooling tubes need not be provided at all. Still further, harmful mists are removed effectively by the concentration device and effective ingredients contained in such mists can be collected and used again as chemicals of the plating solution. Thus, there can be attained great economical and industrial advantages by this invention.

Although the use of counter-current flow of wash water virtually eliminates loss of chemicals by drag-out and the packed column of the concentration is effective in recovery of chemicals rising from the surface-treatment tank *b* as mist, no recovery process is 100% effective. Moreover, in surface treatments such as plating, some metal will be removed from the system as deposit on plated articles. Consequently make-up, or replacement of depleted components must be arranged. The replacement rate can be based on routine analysis of samples taken from surface-treatment tank *b* or of readings made through the use of ion-specific electrodes, etc. Replacement can be either continuous or intermittent. Since all of the solutions used in the system eventually return to surface treatment tank *b*, make-up solution or solids can be introduced either directly into tank *b* or into storage tank 12 of FIG. 1.

Another embodiment of this invention will now be described by reference to FIG. 2.

A surface-treatment tank *b* constituting the chromium-plating step and a plurality of water-washing tanks *c*, *d*, *e*, *f* and *g* constituting the water-washing step are so disposed that articles to be plated are immersed successively in these tanks. More specifically, the surface treatment tank *b* is connected to a concentration device 4 in such a way that the chromium-plating solution overflows from surface-treatment tank *b*, is transferred by a pump 1 after passage through a receiver tank 51 disposed outside the above tank system, introduced into a heat exchanger 2 where the temperature is elevated to a prescribed level, and is sprayed into concentration device 4 from spray tube 6 after passage through liquid-receiving tank 3 and main tube 5. The sprayed plating solution is brought into contact with a gas in a packed bed 8 of the concentration device 4, and flows down into a storage tank 12 provided in the lower portion of the concentration device 4, whence it is returned to surface-treatment tank *b* or a liquid-receiving tank 51 through tubes 13 or 13' by gravity.

Harmful mist generated from the treating solution in surface-treatment tank *b* is sucked into draft box 9, passed through air filter 10 and introduced into the concentration device 4 through exhaust-gas tube 41. The thus-introduced mist is evaporated, purified and absorbed in the packed bed 8 by gas-liquid contact with the process solution already heated by the heat exchanger 2, and harmful ingredients contained in the mist are trapped by mist catcher 7. The remaining gas is discharged as purified air into the open air by exhaust fan 11.

The steam used for heat exchange in the heat exchanger is introduced in the form of condensate into storage tank 14 through tube 33 and is stored therein. This condensed water is introduced at a prescribed rate as washing water into the final water washing tank *g* through a tube 37 and a flow meter 56 or control valve by means of a pressure pump 16. The water washing tanks are constructed so that the water washing can be performed without discharge of waste water.

The liquid levels of water washing tanks *c*, *d* and *g* decrease gradually in the direction from the final washing tank *g* toward the first washing tank *c* located at the position closest to surface-treatment tank *b* so that the rinsing liquid flows in a counter-current manner to plated articles; tanks *c*, *d* and *g* are connected by overflow tubes 20 and 21. The flow rate of the rinsing liquid is maintained constant by means of flow meter 56. As in the embodiment shown in FIG. 1, the liquid level of surface-treatment tank *b* is monitored by a sensor (not shown), and the flow rate of the rinsing liquid can be controlled by switch-over of a control valve (not shown) such as an electromagnetic valve disposed in a tube 35 forming a return passage.

The first water-washing tank *c* disposed in the position adjacent to the surface-treatment tank *b* is connected to a receiving tank 51 by means of a tube 50 so as to introduce the process solution from the tank *c* into the receiving tank 51. A liquid level detecting member 53 is disposed in the receiving tank 51 to change the temperature of the process solution circulated between the concentration device 4 and receiving tank 51 in response to the change of the liquid level of the process solution coming from the surface-treatment tank *b* and first water-washing tank *c* and introduced into receiving tank 51. This detecting member 53 is connected to a member 54 for controlling the feed rate of the heat medium of the heat exchanger 2, for example, an electromagnetic valve, so that the evaporation rate of the process solution is controlled appropriately.

Flow-adjusting valves 55 and 55' are disposed in tubes 13 and 13' acting as return passages for the process solution which has been concentrated in the concentration device 4, so that the amount of the process solution circulated back to surface-treatment tank *b* and the receiving tank 51 from the concentration device 4 is controlled.

Figure 2:
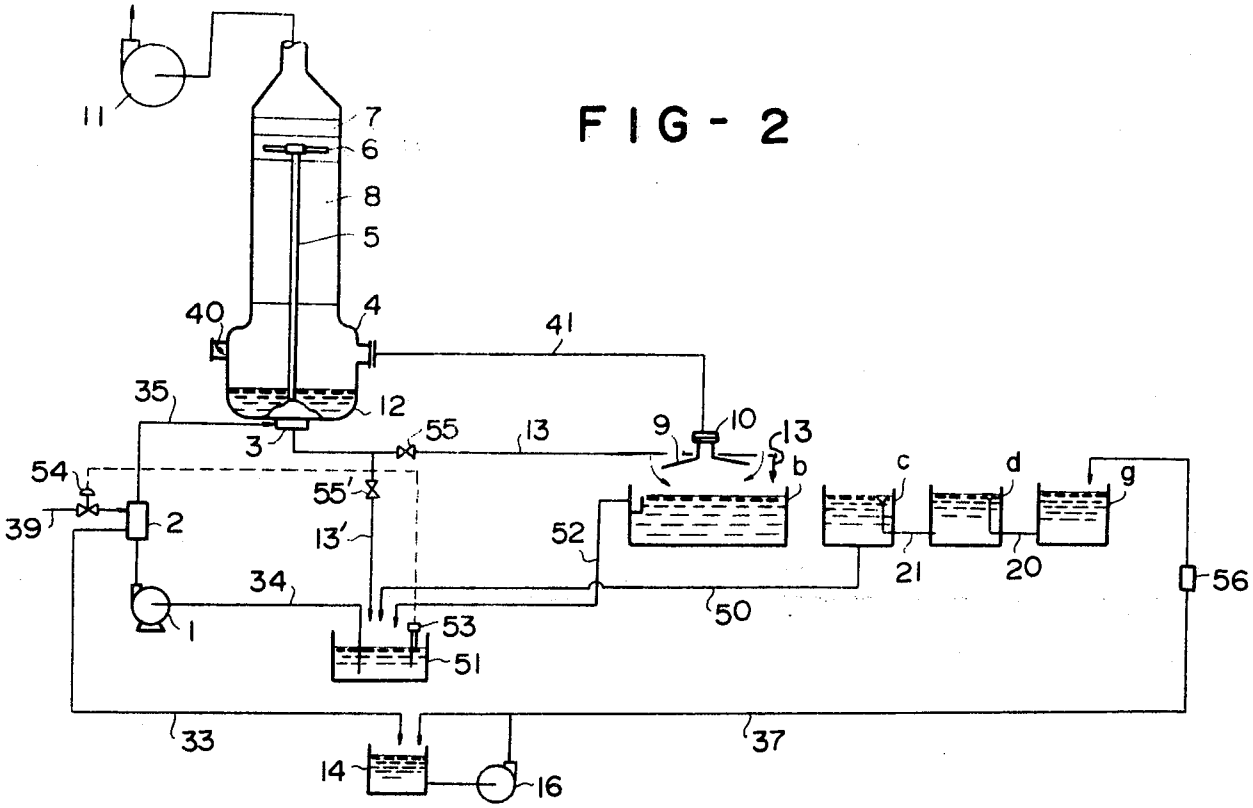
FIG. 2 is a flow sheet of another embodiment of this invention.

In FIG. 2, reference numerals 34 and 52 indicate tubes for circulation of the process solution, reference numeral 40 indicates a suction valve, and 39 is a tube for feeding a heat medium such as steam.

An article to be treated passes through surface-treatment tank *b* and is successively immersed in a series of water-washing tanks *c*, *d* and *g*, whereby the plating of the article is completed. At the treatment step, however, the surface-treating solution is introduced as drag-out into the next water-washing tank.

The process solution overflowing from the first water washing tank *c* is introduced into receiving tank 51 through tube 50 and is combined with the process solution overflowing from surface-treatment tank *b*. In this manner, the amount of process solution in the receiving tank 51 gradually increases, and when the liquid level reaches a prescribed high level, the detecting member 53 is actuated to open the electromagnetic valve 54 of the heat medium supply tube 39 connected to the heat exchanger 2, so that the process solution in the concentration device 4 is gradually heated to increase the evaporation rate in the concentration device 4. When the evaporation rate exceeds the rate of supply of water to the final water washing tank *g*, the liquid level of the receiving tank 51 gradually drops, and when the liquid level reaches a prescribed low level, the electromagnetic valve 54 is turned off. In this manner, the evaporation rate is controlled in the concentration device 4. By the above-mentioned automatic control of the evaporation rate, it is made possible to maintain the amount of the rinsing liquid at a constant level at the water-washing step and attain a uniform washing effect, and it is also made possible to control effectively the capacity of the concentration device 4 by converting the change of the liquid level in the receiving tank 51 to the temperature of the process solution at the concentration step.

In this embodiment, the concentration of the process solution is gradually increased by repetition of the surface treatment operation. Since it is not desired that the concentration should become drastically higher than the prescribed concentration, in order to prevent excessive increase of the concentration of the process solution, a part of the solution returning to the surface treatment tank *b* from the concentration device 4 is continuously introduced into the receiving tank 51 directly, whereby the solution concentration is controlled in both the tanks and the lowering of the liquid level by natural evaporation is controlled in the surface-treatment tank *b*.

According to the embodiment illustrated in FIG. 2, the function of the concentration device 4 is controlled by the process solution overflowing from the water-washing tanks and surface-treatment tanks so that the amount of rinsing liquid is maintained at a constant level at the water-washing step, whereby the effect of washing plated articles can be kept uniform and the washing operation can be conducted in a completely closed system without discharge of waste water. Thus, in this embodiment, the evaporation operation in the concentration device can be performed stably regardless of the liquid temperature in the surface-treatment tank, this result being attained in addition to the effects attained in the embodiment shown in FIG. 1. More specifically, all of the process solution which overflows or drained from the water-washing tanks is directly introduced into the receiving tank through tubing and the circulation of the process solution is completely shut by closing selectively the valve disposed in the tube passage extending from the concentration device to the surface-treatment tank.

This specific structure of FIG. 2 brings about the following characteristic features. In case the temperature of the process solution is as low as, for example, about 20°C., it is not desired that the heated solution is circulated among the receiving tank, concentration device and surface-treatment tank, because it results in change in the temperature of the liquid in the surface-treatment tank. In such a case, according to the embodiment shown in FIG. 2, it is made possible to conduct the surface treatment while adjusting the liquid temperature in the surface-treatment tank to a temperature suitable for the surface treatment and to raise the liquid temperature in the concentration device to a level corresponding with the evaporation rate. In short, control of the liquid temperature can be performed separately in the surface treatment tank and the concentration device. Further, when after completion of the operation the process solution in the receiving tank is naturally cooled by, for instance, standing still overnight or positively cooled by appropriate means, it is possible to return the process solution to the surface-treatment tank for rendering uniform the concentration in the entire process solution. Therefore, in this embodiment, effective operation is assured and the metal surface treatment can be performed with great economical and industrial advantages.

In the embodiment of FIG. 2, replenishment can be carried out by addition of solutions or solids to tank 51.

The washing step of this invention and an example of a washing tank to be used at the washing step will now be described by reference to an embodiment shown in FIGS. 3 and 4.

In at least one water-washing tank subsequent to the surface-treatment tank, a partition wall is provided so as to store the process solution in a state divided into a portion of a higher concentration and another portion of a lower concentration, whereby the water washing can be conducted effectively. More specifically, in the embodiment of FIGS. 3 and 4, water-washing tank *c* is fixed to a base, and a vertical partition wall 66 is disposed to extend to the lower end of a plated article A so that the tank *c* is divided into an inner chamber 60 and an outer chamber 59. The rinsing liquid in an amount equal to the amount of the rinsing liquid supplied to the subsequent water-washing tank *d* is continuously taken from an overflow tube 21 connected to water-washing tank *c* and is stored in outer chamber 59. A spray pump 61 connected to outer chamber 59 is actuated in response to the operation of an article-transporting machine or a signal sent from suitable means when the article A is introduced in the tank *c*, and the rinsing water is projected onto the article A from spray nozzle 62 connected to spray pump 61, whereby the washing of the article A is accomplished. After the article A has been held in the water-washing tank *c* for a certain period, it is withdrawn from tank *c* and operation of the spray nozzle 62 is stopped. Since the treating solution having the same concentration as in the surface treatment tank adheres to the surface of the article A, the rinsing liquid falls and is recovered in the inner chamber in the form of a solution of a relatively high concentration, and it is then introduced by gravity and stored in receiving tank 63. A level gauge 65 is mounted on this receiving tank 63 so that it actuates water feed pump 64 when the liquid level becomes high in tank 63 and the rinsing liquid is forwarded to surface-treatment tank *b* through tube 67; when the liquid level is thus lowered, the operation of the pump 64 is stopped. A part of the water sprayed from the spray nozzle that has not impinged against the article A hits the tank wall and falls into outer chamber 59, and it is used again as spray liquid.

The tube 67 extending to surface-treatment tank *b* can be connected to the receiving tank 51 as is illustrated in FIG. 2. Further, instead of tank *c*, tank *d* can be constructed in the above-mentioned manner by means of a partition wall and the tube 67 (FIG. 3) extending from the receiving tank 63 is connected to tank *c* located in the position closer to the surface-treatment tank *b*.

In this embodiment, it is advantageous that water is always supplied to the final water-washing tank through a bypass valve 18 such as shown in FIG. 1 at a rate equal to the rate of water sprayed from the spray nozzle 62.

When plated articles are washed according to the foregoing process, articles A are always washed by a rinsing liquid of a lower concentration in, for example, the washing tank *d*, the second tank counted from the side of the surface-treatment tank *b* in the foregoing embodiment, and therefore, the water-washing tank *d* can attain such a high washing effect as attainable by two ordinary water-washing tanks, thereby making it possible to eliminate one water tank. For instance, when three water-washing tanks are provided as in the case of the foregoing embodiment, the effect attainable by four ordinary washing tanks can be attained, and if the water-washing tank *d* is formed to have the same structure as that of the tank *c*, the effect attainable by five ordinary tanks can be expected. Furthermore, the entire space for the surface treatment can be minimized.

Figure 3:
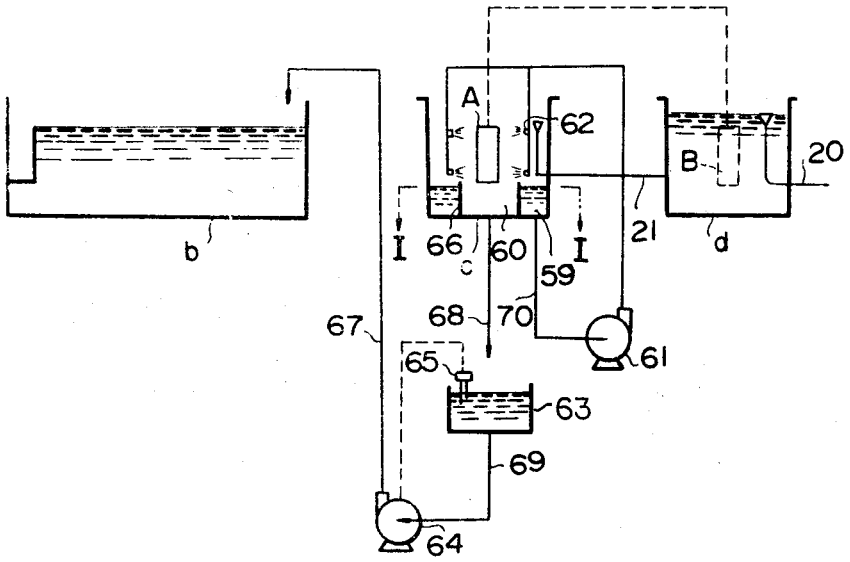
FIG. 3 is an enlarged view illustrating the water washing step which constitutes a part of this invention.
Figure 4:
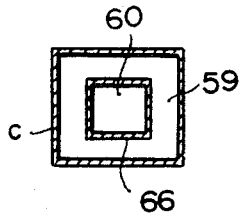
FIG. 4 is a plan view showing the section taken along line I—I of FIG. 3.

In FIG. 3, reference numerals 68 and 69 indicate tubes for withdrawal of the rinsing liquid. In the embodiment shown in FIG. 3, the water-washing tank *c* is so constructed that after the process solution of a lower concentration has been withdrawn from the outer chamber 59, it is recycled to the same tank. However, it is possible to adopt such a structure that all or a part of the process solution withdrawn from the outer chamber 59 of the tank *c* is used as a spray liquid for another tank, for example, the tank *d*.

When the water-washing process shown in the foregoing embodiment is utilized, a part or all of one or more tanks provided subsequently to the surface-treatment tank can be so constructed that the process solution is stored partly as a high concentration portion and partly as a low concentration portion, and when the water-washing process of this embodiment is combined with the foregoing two embodiments illustrated in FIGS. 1 and 2, in addition to the effects attained by these two embodiments, there can be attained the following important economical and industrial advantages. Specifically, the number of the water-washing tanks can be reduced and the quantity of water to be used for the washing treatment can be greatly reduced. Moreover, the entire space of the surface treatment plant can be minimized.

A preferred embodiment of the concentration device to be used in this invention, which includes improved water-sprinkling tube and filler and has a simple structure and which can be manufactured at a low cost, is illustrated in FIGS. 5 to 8.

According to this preferred embodiment there is provided an apparatus for concentrating a metal-surface treating-solution, characterized in that a main tube for the treating solution is mounted on the center of a concentrator proper, a rotation head is connected to the top end of the main tube, one water-sprinkling tube or a plurality of water-sprinkling tubes are mounted on said rotation head, and small holes are perforated at an optional pitch on the water-sprinkling tube at a position forming an optional angle to the sectional horizontal direction so that the water-sprinkling tube is spontaneously rotated by reaction of fluids projected from said small holes to sprinkle water uniformly throughout a column, and that a filler composed of a thin film of a synthetic resin or the like and having a creased and folded shape is used, said filler having such a structure that it provides a large contact area. The filler can be placed in the column so that no open voids remain therein, and it can allow the vapor formed by the gas-liquid contact to escape from the column quite easily.

Such a concentration apparatus is shown in FIGS. 5 to 8.

Figure 7:
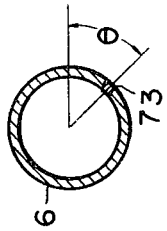
FIG. 7 is a view illustrating the section taken along the line III—III of FIG. 5.
Figure 6:
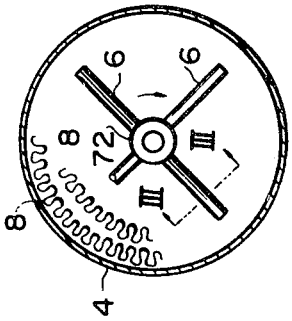
FIG. 6 is a view illustrating the section taken along line II—II of FIG. 5.
Figure 8:
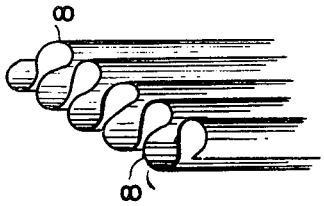
FIG. 8 is a view illustrating in enlarged scale, a portion of a packed bed fitted to the concentration device.
Figure 5:
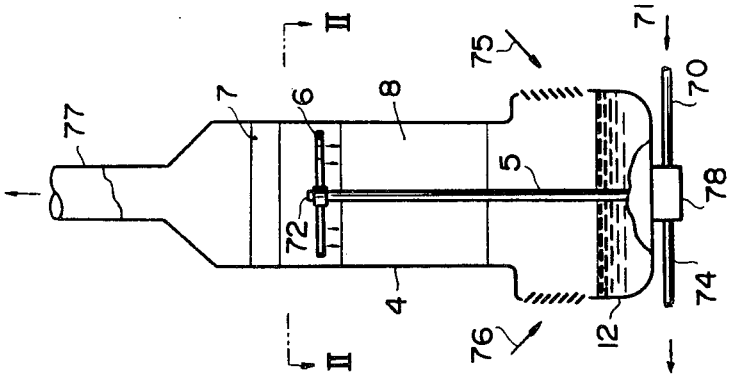
FIG. 5 is a view in vertical section of the concentration device of this invention.

In FIG. 5 reference numeral 70 indicates an inlet tube, and the solution is usually fed thereto by means of a pump or the like. The process solution 71 is passed through this inlet tube 70 and main tube 5 positioned at the center of concentrator 4 and reaches rotation head 72 fitted on the upper portion of main tube 5. As in shown in FIG. 6, at least one water-sprinkling tube 6 (preferably four water-sprinkling tubes) is mounted on this rotation head 72. On the water-sprinkling tube 6, as is shown in FIG. 7, small holes are perforated at an optional pitch in correspondence with the size of the water-sprinkling tube so that liquid can be uniformly distributed in the column. The diameter of the small hole is generally within a range of 1 to 50 mm, preferably about 10 mm, and the small hole is so perforated that an angle $\theta$ is formed with respect to the sectional horizontal direction. Since the reaction of the solution projected from the small hole varies depending on the pressure of the solution and the amount projected therethrough, the angle $\theta$ can be changed so as to obtain a desired rotation rate of water-sprinkling tube 6. In the foregoing structure, the solution which has passed through the main tube 5 is uniformly distributed in the column from water-sprinkling tube 6, and then, the sprinkled solution passes through a packed bed 8 and reaches storage tank 12, and thereafter the solution is discharged from the tank 12 by outlet tube 74. A pump or the like is generally utilized as a means for forming such circulation system of the process solution. In view of the function of the concentrator, the temperature of the process solution should be maintained at a level higher than the wet-bulb temperature, and the operation is usually conducted while maintaining the process solution at 50° to 60°C. The capacity of the concentrator can be heightened by, for example, increasing the evaporation rate. It will be obvious to those skilled in the art that good results can be obtained by increasing the difference between the process-solution temperature and wet-bulb temperature by elevating the process-solution temperature after due consideration of the heat resistance and corrosion resistance of the gas-liquid contact zone, within such a range as will not cause decomposition of the process solution or have a deleterious influence on the process solution. It will also be apparent to those skilled in the art that the wet-bulb temperature varies with the season, namely it is higher in summer and lower in winter, and the concentration capacity is also changed depending on the wet-bulb temperature in the same concentrator.

The outer air 75 to be brought into contact with the warm process solution in the packed bed 8 to effect transfer of substances between them is passed through a louver 76 mounted in the lower portion of the column and flows through the packed bed 8 in a counter-current manner to the process solution. Fine mists entrained in the gas are trapped by means of a mist catcher 7 and the gas is discharged outside the system through vent 77. In packed bed 8, heat exchange is accomplished by utilizing the difference of the latent heat between the process solution and outer air. The shape of the filler is so arranged that it is also made possible to gasify and eliminate the vapor formed by this heat transfer as quickly as possible.

The body of the concentrator 4 is ususlly composed of F. R. P. (glass fiber-reinforced polyester resin) and this F. R. P. concentrator is characterized by a high mechanical strength, a good corrosion-resistance, a good weatherability, a good heat resistance and a light weight. A drain outlet 78 is dispoed in the lower portion of lower store tank 12 of the column so that the amount of the process solution in the tank is extremely small and air is not introduced into a suction tube of a pump or the like.

In case a conventional packed bed is used, a spray nozzle or the like is readily clogged and cleaning of clogged nozzles involves difficulties. Further, high power must be used for spraying of the process solution. In addition to these defects, the conventional packed bed has another defect that mists generated in the concentrator are carried away by the air current. Furthermore, coarse dusts readily choke fillers used in the conventional packed bed. Especially in the night, when the temperature decreases or the like, reaction products are formed in the process solution and they readily clog the packed bed, resulting in pressure loss. In contrast, if the concentrator of this embodiment is applied to the process and apparatus of this invention, the process solution can be effectively sprayed without using high power for spraying and by virtue of the specific structure of this concentrator in combination with the above-mentioned specific structure of the preferred filler, the concentration can be performed effectively and great industrial advantages can be attained.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

It is also to be understood that the following claims are intended to cover all of the generic and specific features of the invention herein described, and all statements of the scope of the invention, which, as a matter of language, might be said to fall therebetween.

What is claimed is:

1. In a process wherein articles are to be treated in a surface-treatment tank containing process solution having chemical-surface-treating agents therein and washed with wash water in a plurality of series-connected water-washing tanks, the improvement comprising the steps of introducing condensate water at a constant rate from a condensate-storage tank into the water-washing tank furthest from said surface-treatment tank, successively treating said articles in said surface-treatment tank and washing said articles in said series-connected water-washing tanks, transferring said wash water in a direction counter-current to the movement of said articles through said water-washing tanks from the tank furthest from said surface-treatment tank to the tank nearest to said surface-treatment tank, transferring overflow process solution from said surface-treatment tank and overflow water from said water-washing tank nearest said surface-treatment tank to a first receiving tank, transferring process solution from said receiving tank through a heat-exchanger and thence to a concentrator, subjecting said process solution to a concentration treatment in said concentrator, returning concentrated process solution to said surface-treatment tank and to said receiving tank in a controlled ratio, sensing the liquid level in said receiving tank and adjusting the heat input to said heat-exchanger in response to said liquid level, an increase in liquid level calling for an increase in heat input, supplying said heat input as condensing steam by way of said heat-exchanger to cause evaporation of water in said concentrator, transferring the condensate from said heat-exchanger to said condensate storage tank, collecting any mist and harmful gases arising from said surface-treatment tank and subjecting said mist and gases to counter-current contact with process solution in said concentrator to recover active constituents of said process solution from said mist and gases, the extent of concentration being related to the quantity of wash-water introduced into said water-washing tank and the quantity of condensate formed in said heat-exchanger so that said tanks and concentrator may function as a closed system without discharge of surface-treatment ingredients or waste water to the exterior of the system.

2. The improved process as defined in claim 1, wherein at least one water-washing tank is divided into two water-containing compartments, one of said compartments containing water having therein a higher concentration of surface-treating agents than the other, the flow of wash-water being from the compartment of lower concentration to the other of said compartments and liquid being taken from said other compartment to said receiving tank and thence to said concentrator for concentration.

3. The improved process as defined in claim 1, wherein at least one water-washing tank in divided into two water-containing compartments, one of said compartments containing water having therein a higher concentration of surface-treating agents than the other, and the contents of said other being sprayed against treated articles, the runoff from said treated articles being transferred to said one compartment.

4. The improved process as defined in claim 1, wherein said process solution contains chloride ion and electrolysis of said solution is carried out under conditions such as to remove excess chloride ion.

5. The improved process as defined in claim 3, wherein the content of said one compartment is first transferred to a second receiving tank containing a liquid level sensor, and thence to said first receiving tank at a rate such as to keep the liquid level in said second receiving tank between preset limits.

6. The improved process as defined in claim 1, wherein process solution from said surface-treatment tank is passed through purification means.

7. The improved process as defined in claim 1, wherein concentrated solution from said concentrator is divided between said receiving tank and said surface-treatment tank to maintain the concentration of effective ingredients constant in both of said tanks.

* * * * *